US005884766A

United States Patent [19]

Marou

[11] Patent Number: 5,884,766

[45] Date of Patent: Mar. 23, 1999

[54] ROOM LIGHT LOAD FILM MAGAZINE BAG AND COVER LOADING SYSTEM

[75] Inventor: Michael Marou, Rochester, N.Y.

[73] Assignee: Eastman Kodak Company, Rochester, N.Y.

[21] Appl. No.: 897,751

[22] Filed: Jul. 21, 1997

[51] Int. Cl.[6] ..... B65D 81/00

[52] U.S. Cl. ..... 206/455

[58] Field of Search ..... 206/454, 455, 206/456, 449, 484

[56] References Cited

U.S. PATENT DOCUMENTS

| | | | |
|---|---|---|---|
| D. 331,937 | 12/1992 | Moon . | |
| 1,527,938 | 2/1925 | Tousey . | |
| 1,952,096 | 3/1934 | Saffir . | |
| 2,976,989 | 3/1961 | Wiesner . | |
| 3,741,386 | 6/1973 | Schmidt . | |
| 4,179,207 | 12/1979 | Phillips . | |
| 4,537,307 | 8/1985 | Tamura . | |
| 4,727,391 | 2/1988 | Tajima et al. . | |
| 4,738,366 | 4/1988 | Schmidt et al. . | |
| 4,799,591 | 1/1989 | Tajima et al. . | |
| 4,894,264 | 1/1990 | Akao et al. . | |
| 4,894,674 | 1/1990 | Radov . | |
| 4,912,740 | 3/1990 | Liese, Jr. . | |
| 4,915,229 | 4/1990 | Yamada et al. . | |
| 4,955,479 | 9/1990 | Beer et al. . | |
| 4,985,721 | 1/1991 | Moon . | |
| 5,019,849 | 5/1991 | Harrison . | |
| 5,048,685 | 9/1991 | Kausch et al. | 206/455 |
| 5,083,665 | 1/1992 | Schoenberg et al. . | |
| 5,118,563 | 6/1992 | Akao . | |
| 5,139,148 | 8/1992 | Peeters et al. . | |
| 5,156,331 | 10/1992 | Pirre | 206/455 |
| 5,199,569 | 4/1993 | DiPietro et al. . | |
| 5,251,755 | 10/1993 | Kausch . | |
| 5,257,697 | 11/1993 | Kausch . | |
| 5,377,835 | 1/1995 | Cornelissen et al. . | |
| 5,390,793 | 2/1995 | Kausch et al. . | |
| 5,395,681 | 3/1995 | Hargarter et al. . | |
| 5,466,561 | 11/1995 | Rantanen . | |
| 5,492,741 | 2/1996 | Akao et al. . | |

FOREIGN PATENT DOCUMENTS

| | | |
|---|---|---|
| 0 572 568 B1 | 1/1995 | European Pat. Off. . |
| 6 3085540 | 4/1988 | Japan . |
| 63-75744 | 4/1988 | Japan . |
| 63-186238 | 5/1988 | Japan . |
| 994258 | 6/1965 | United Kingdom . |

*Primary Examiner*—Jacob K. Ackun
*Attorney, Agent, or Firm*—James D. Leimbach

[57] ABSTRACT

The present invention provides a load bag and carrier board design that will allow the user to load film in a darkroom load magazine in room light. This is accomplished by tearing the bag open along the perforations and pulling off the outer bag. The bag and film are loaded into the magazine; as the access door is closed, the outer bag is pulled off. A label is placed at the bottom panel of the outer bag to identify package orientation and alert the user when the end of the bag is reached. At this point the package allows film to be loaded in room light conditions with a high risk of light fog on the edge (⅛") of the film. The fog is concentrated on the top edge of the film closest to the cassette door. With the addition of the cassette cover, the end user can load film in white light with no fog concerns.

1 Claim, 1 Drawing Sheet

ROOM LIGHT LOAD FILM MAGAZINE BAG AND COVER LOADING SYSTEM

FIELD OF THE INVENTION

The invention relates generally to the field of room light load packaging for film intended for cassettes.

BACKGROUND OF THE INVENTION

Currently, laser imagers have darkroom load magazines available to load film. Such systems require that the user load the magazine with film in a darkroom. The user takes the empty magazine, into the darkroom, loads the film into the magazine and returns back to the imager. With this invention the magazine would be loaded at the imager in room light. From the foregoing discussion it is apparent that there remains a need within the art for a film load bag that can be used with film magazines in room light.

SUMMARY OF THE INVENTION

The present invention is directed to overcoming one or more of the problems set forth above. Briefly summarized, according to one aspect of the present invention, A room light load magazine bag is provided comprising: a carrier board having light tight means formed on essentially half the carrier board near a first end of the carrier board; an outer bag made of opaque material formed to contain the carrier board, the outer bag having perforations contained at the first end of the carrier board.

These and other aspects and advantages of the present invention will be more clearly understood and appreciated from a review of the following detailed description of the preferred embodiments and appended claims, and by reference to the accompanying drawings.

Advantageous Effect Of The Invention

The present invention has the following advantages:

Ease of opening—perforations allow the user to open the outer bag without a cutting tool.

Label on the outer bag indicates proper orientation (top and bottom).

Carrier board on one end is light tight.

Carrier board allows the imager to detect for out of film, and

User can load package in room light.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
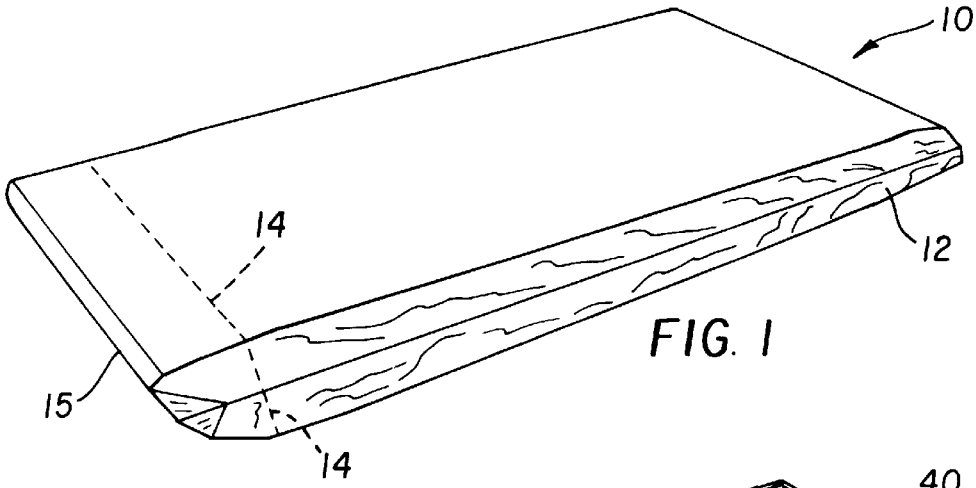
FIG. 1 is a perspective view of a room light film loading bag as envisioned by the present invention.

Referring to FIG. 1, a perspective view of the room light load bag 10 as envisioned by the present invention is illustrated. It has been discovered that light sensitive film can be loaded effectively into cassette without the necessity of a darkroom by supplying the outer bag room load bag 10 with particular internals to prevent enclosed film from fogging. As seen in FIG. 1 there is an outer bag 12 with perforations has an outer bag 12 with perforations 14 near one end of the outer bag 12. approximately 1 inch from the sealed end of the bag 10.

Figure 2A:
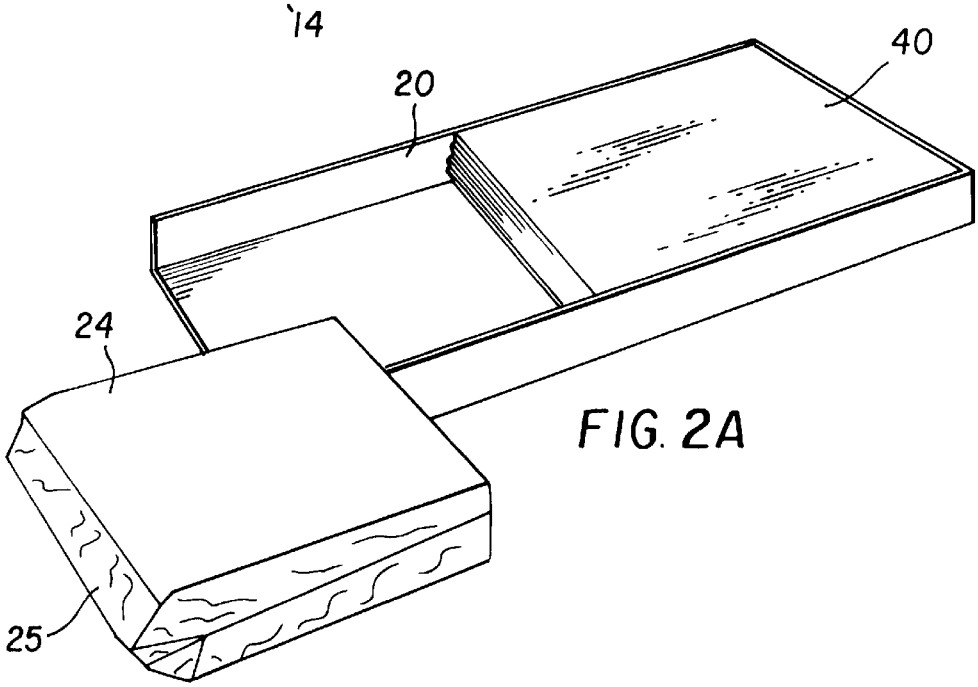
FIG. 2A is an illustration of a carrier board used with the present invention.
Figure 2B:
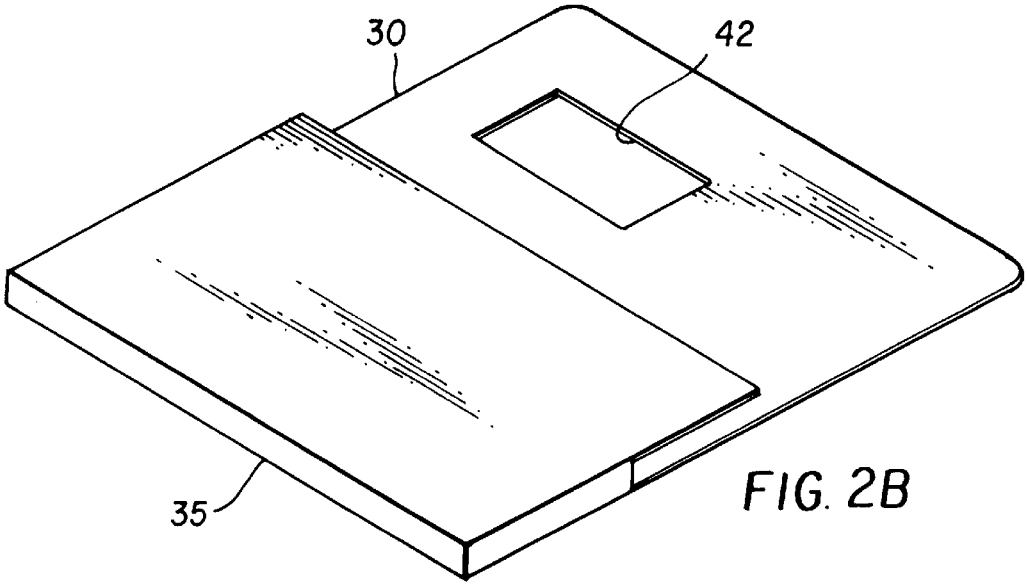
FIG. 2B is an illustration of a second embodiment of the present invention.

Referring now to FIG. 2A in conjunction with FIG. 1, the details the internals used within the outer bag 12 are shown in FIG. 2A, a carrier board 20 made from cardboard or carton stock is used to add rigidity to the package. The user tears away the perforations 14 remove the bottom portion 15 of outer bag 12 to gain access to the package inside outer bag 12. Once the bottom portion 15 is torn away, the bottom portion 25 of inner bag 24 is exposed to ambient room light. This does not fog film 40 contained within carrier board 20 because the remaining portion of outer bag 12 and inner bag 24 create a light tight seal for enclosed film 40. The user then takes the load bag 10 with bottom portion 15 removed and inserts it into a load magazine that was originally intended to be loaded with film inside a darkroom environment. This has the advantage of allowing the user to operate in normal room light conditions with the inner bag 24 and outer bag 12 absent bottom portion 15 providing as a light tight environment. Typically there is a mechanism within the internals to load bag 10 that informs the imager using the enclosed film when the film supply has run out. A cut-out (not shown) in the bottom of carrier board 20 would be such a mechanism.

Referring now to FIG. 2A in conduction with FIG. 1, a second preferred embodiment of the invention is shown having a carrier board 30 that has a bottom portion 35 shaped to perform the function of the bottom portion 25 of inner bag 24 seen in FIG. 2A. This bottom portion 35 to carrier board 30 will then provide the light tight seal when bottom portion 15 to outer bag 12 is removed in ambient light conditions. Again, the carrier board 30 is made of cardboard or carton stock only in the embodiment shown in FIG. 2A, the carrier board 30 is dye cut and scored, so when assembled encloses half of the film stack and prevents light from exposing the film. The user tears away the perforations 14 to gain access to the enclosed package. At this point the light tight bottom portion 35 the carrier board 30 is exposed. The user would take the whole package and insert it into the darkroom load magazine. Typically a cut-out 42 is placed on the bottom of the carrier board 30 that allows the imager to sense when the film has run out.

The present invention provides a load bag and carrier board design that will allow the user to load film in a darkroom load magazine in room light. This is accomplished by tearing the bag open along the perforations and pulling off the outer bag. The bag and film are loaded into the magazine; as the access door is closed, the outer bag is pulled off. A label is placed at the bottom panel of the outer bag to identify package orientation and alert the user when the end of the bag is reached. At this point the package allows film to be loaded in room light conditions with a high risk of light fog on the edge (⅛") of the film. The fog is concentrated on the top edge of the film closest to the cassette door. With the addition of the cassette cover, the end user can load film in white light with no fog concerns.

The invention has been described with reference to a preferred embodiment; However, it will be appreciated that variations and modifications can be effected by a person of ordinary skill in the art without departing from the scope of the invention.

| PARTS LIST |
|---|
| 10 load bag |
| 12 outer bag |
| 14 perforations |
| 15 bottom portion |
| 20 carrier board |
| 24 inner bag |
| 25 bottom portion |
| 30 carrier board |
| 35 bottom portion |
| 40 film |
| 42 cut-out |

What is claimed is:

1. A method room light loading of film into magazines comprising the steps of:

providing a carrier board having light tight means near a first end of the carrier board and a stack of film on the carrier board such that the light tight means envelope the film stack at the first end within an outer bag that has perforations at one end such that the first end of the carrier is at the one end of the outer bag, the outer bag having an indicator near the first end and the carrier board is sealed within the outer bag;

removing the perforations at the one end of the outer bag;

inserting the outer bag into a dark room load cassette that has a sliding door wherein the sliding door is partially opened.

removing the outer bag while simultaneously closing the sliding door of the cassette until the indicator is apparent; and pinching the outer bag with the sliding door and remove the remaining outer bag.

* * * * *